US006935212B2

(12) United States Patent
Wadsworth

(10) Patent No.: US 6,935,212 B2
(45) Date of Patent: Aug. 30, 2005

(54) MULTIPURPOSE BI-LATERAL MULTI-AXIAL RATCHETING HAND TOOL

(76) Inventor: Jake Wadsworth, 20 Dublin Gulch Rd., St. Ignatius, MT (US) 59865-9445

( * ) Notice: Subject to any disclaimer, the term of this patent is extended or adjusted under 35 U.S.C. 154(b) by 0 days.

(21) Appl. No.: 11/029,063

(22) Filed: Jan. 3, 2005

(65) Prior Publication Data

US 2005/0109165 A1 May 26, 2005

Related U.S. Application Data

(63) Continuation of application No. 29/191,569, filed on Oct. 9, 2003, now Pat. No. Des. 503,319.

(51) Int. Cl.[7] ..... B25B 13/46
(52) U.S. Cl. ..... 81/60; 81/440; 81/177.7; 81/62
(58) Field of Search ..... 81/60, 62, 437–439, 81/177.2, 177.4, 490, 177.6, 440, 177.7, 81/177.8, 427.5

(56) References Cited

U.S. PATENT DOCUMENTS

| | | | | |
|---|---|---|---|---|
| 438,860 | A * | 10/1890 | Pratt | 81/62 |
| 916,620 | A * | 3/1909 | Shaul | 81/62 |
| 2,713,281 | A | 7/1955 | Poteet | |
| 3,766,811 | A | 10/1973 | Callahan | |
| 3,823,624 | A | 7/1974 | Martin | |
| 4,566,357 | A | 1/1986 | Carossino | |
| 4,790,219 | A * | 12/1988 | Will | 81/63 |
| 5,329,834 | A | 7/1994 | Wong | |
| 5,606,758 | A | 3/1997 | Tung | |
| 6,279,435 | B1 * | 8/2001 | Zayat, Jr. | 81/440 |
| 6,314,838 | B2 | 11/2001 | Wall | |
| 6,332,381 | B1 | 12/2001 | Vasudeva | |
| 6,601,481 | B2 | 8/2003 | Chuang | |

* cited by examiner

*Primary Examiner*—Debra S Meislin
(74) *Attorney, Agent, or Firm*—Derek H. Maughan; Dykas, Shaver & Nipper

(57) ABSTRACT

A multipurpose, bi-lateral multi-axial ratcheting hand tool. The ratcheting hand tool may be used in multiple positions and in varying angles for loosening or tightening various fasteners as well as using other tools that may be attached to the tool. The ratcheting Allen wrench includes a first handle and a second handle, a bi-directional ratchet hingedly fastened between the first handle and the second handle, and multiple tools hingedly fastened to the first handle and the second handle that may be easily accessed and foldably stored within the handle when not in use.

18 Claims, 5 Drawing Sheets

MULTIPURPOSE BI-LATERAL MULTI-AXIAL RATCHETING HAND TOOL

PRIORITY

This application is a continuation and claims the priority date of a application entitled Ratcheting Tool Set filed by Jake Wadsworth on Oct. 9, 2003 with application Ser. No. 29/191,569 now U.S. Pat. No. D,503,319.

BACKGROUND OF THE INVENTION

1. Field of the Invention

The present invention generally relates to adjustable hand tools and more particularly, to a multi-purpose, bi-lateral multi-axial ratcheting hand tool.

2. Background Information

The necessity to fasten and remove connecting devices is a problem commonly experienced by a variety of persons. Of particular problem is the situation wherein fasteners of various sizes and shapes are utilized on the same project or within the same local area of work. In such an instance, a party must be able to access and utilize a variety of types and shapes of tools in order to complete the desired tasks. In many instances the use of many tools while working is bothersome and complicated and contributes to tools being lost. Another problem that occurs is that the shaft of some tools are dimensioned in such a way that direct access to a working area is very difficult, therefore a way must be provided which would allow a party to work in a narrowly defined space. Another problem that exists in the prior art is that the amount of torque that can be placed upon a device by a hand tool is severely limited by the angle of access and the hand strength of the user.

Therefore, what is needed is a device that allows a user to access a variety of types of tool heads of varying characteristics by a single tool. What is also needed is a device that provides a user with the ability to work in a variety of smaller spaces with limited access, as well as a device that allows a user to increase the amount of torque that can be placed upon a device by an individual's hand strength.

Accordingly, it is an object of the invention to provide a tool that allows a user to access a variety of types of tool heads of varying characteristics by a single tool. Another object of the invention is to provide a device that enables a user with the ability to work in a variety of smaller spaces with limited access, as well as a device that allows a user to vary the amount of torque that can be placed upon a device by an individual's hand strength.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a multipurpose bilateral multi-axial hand tool made up of a first handle, a ratchet mechanism hingedly fastened to the first handle for engaging in a first selected direction and rotating freely in another selected direction; at least one tool hingedly fastened to the first handle; a second handle hingedly fastened to an opposite end of the ratchet as the first handle; and at least one tool hingedly fastened to said second handle.

For purposes of illustration the invention is described as a ratcheting Allen wrench. However, it is to be distinctly understood that the invention may be variously modified and embodied according to the needs of a user. This would include the use of other tools including screwdrivers, wrenches, blades, and other devices to be added according to the needs and necessities of a user. The ratcheting Allen wrench includes a first and second handle each hingedly attached to a socket mechanism. The handles themselves may be configured to store multiple tools. The first handle has an inner and outer end for gripping and using said ratcheting Allen wrench. The ratcheting mechanism has a first and second end wherein the first end is hingedly connected to the inner end of the first handle by a handle fastener.

The ratcheting mechanism may further include a direction selector for selecting the engaged ratcheting direction. The ratcheting Allen tool further includes a second handle having an inner and outer end for gripping and using the ratcheting Allen wrench in which the inner end of the second handle is hingedly connected to the second end of the ratchet mechanism. A plurality of Allen tools are hingedly attached to the outer end of the first handle and the outer end of the second handle by a tool fastener wherein the Allen tools are preferably hingedly rotated and stored within the first and second handle when not in use.

The first and second handle may define at least one cut-away for easily accessing said plurality of Allen tools from a side of said first or said second handle. The present invention may also include a tool locking mechanism for locking said plurality of Allen tools into a fixed position during use or storage. In a preferred embodiment, the ratcheting Allen wrench may be folded so that the socket is substantially enclosed and/or the first and second handles abut one another lengthwise.

The pivoting connection of the various tools with regard to the handles, as well as the variable positioning of the handles with regard to one another provide various angles and torque forces that can be applied to a screw head. This would allow a user to increase the amount of torque that can be relayed upon the head of the fastener.

The invention is used by unfolding one of the desired tools from within the handle portion and extending this tool a desired degree. The other handle may then be extended to a desired position and the ratchet selected to allow circular rotation in a designated direction. The device can then be rotated so as to allow fasteners to be tightened and loosened according to the needs of a user.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENT

Figure 1:
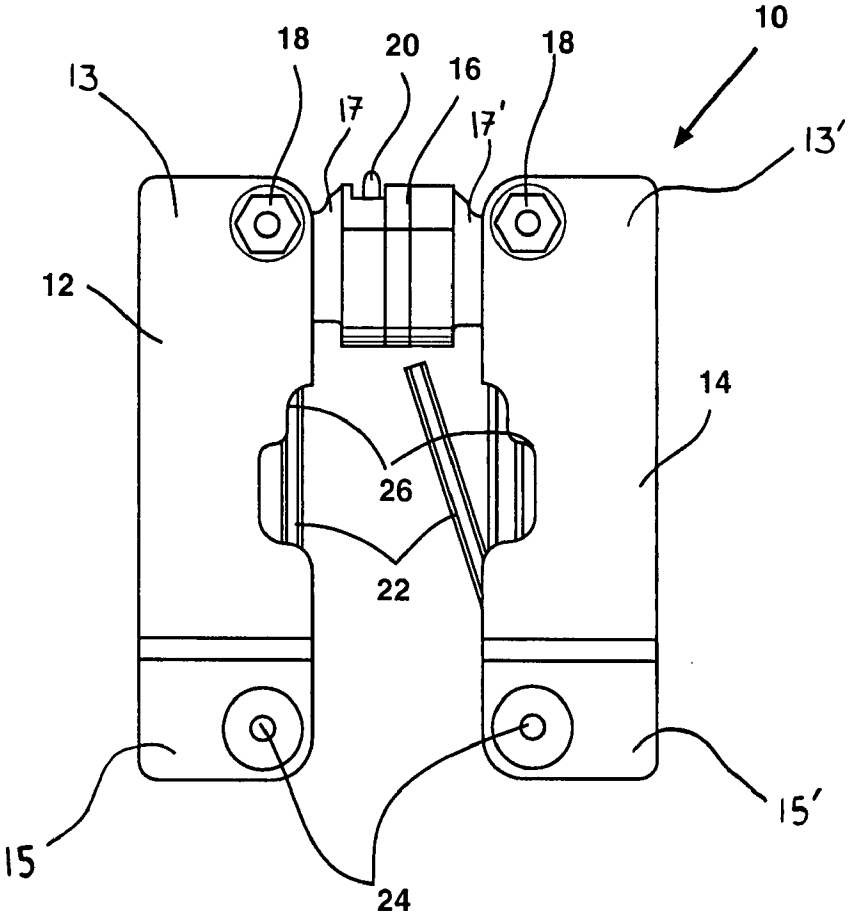
FIG. 1 is a side view of a preferred first embodiment with the handles in a first folded position.

While the invention is susceptible to various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a multipurpose bi-lateral multi-axial ratcheting hand tool that allows a user to-access and select any one of a variety of hand tool heads from a storage position within a handle, move this tool into a desired angular orientation, and use the tool utilizing a ratcheting action to perform any one of a variety of tasks including tightening and loosening fasteners or any one of a variety of other actions depending upon the necessities of the user and the configuration of the various pre-selected tools that are embodied therein. The flexibility and selective configuration of the present embodiment allows a user to keep better control and access to his/her tools, prevent the loss of loose tools, allow access and use of the tools in various locations with limited access and reduced space, and provide a user with the ability to increase the amount of torque that can be placed upon a fastener as compared to other traditional hand tools and their associated methods.

While the preferred present embodiment of the invention is shown as an embodiment utilizing various shaped and sized Allen wrenches, it is to be distinctly understood that the invention is not limited thereto but may be variously embodied to encompass a variety of tool types. The following example is therefore intended to be illustrative in nature and not limiting.

In the preferred embodiment, the invention utilizes a variety of variously shaped Allen wrenches. Referring now to FIGS. 1–5, a variety of views of the preferred embodiment are shown. FIG. 1 shows a side view of the first preferred embodiment with the handles in a first folded position. While a variety of adjustable tools are shown, the adjustable invention is configurable to receive many different tools in varying configurations according to a user's preference. The invention includes a first handle 12 and a second handle 14. The first handle 12 defines an inner end 13 and an outer end 15. The second handle 14 also defines an inner end 13' and an outer end 15', and each handle is configured to allow the invention to be gripped and manipulated. Each of the first and second handles 12, 14 defines chambers configured to hold and store various tools therein.

Attached to the inner end 13 of the first handle 12 and second handle 14 is a ratchet mechanism 16. The ratchet mechanism 16 has a first end 17 and second end 17'. The ratchet mechanism 16 is preferably hingedly connected to the inner end 13 of the first handle 12 by a handle fastener 18, allowing the handles 12, 14 to be used from various angular positions. The inner end 13 of the first handle 12 is attached to the first end 17 of the ratchet mechanism 16. The inner end 13' of the second handle 14 is attached to the second end 17' of the ratchet mechanism 16. In an additional embodiment, the handles are pivotally connected to the ratchet mechanism 16 so that the handles may be rotated in nearly any direction in reaching and adjusting an Allen fastener or other element.

The ratchet mechanism 16 as herein defined is a device that allows a user to turn or apply torque to an Allen fastener in one direction and then move a handle of the ratcheting Allen wrench 10 back, without force, in the opposite direction for the next stroke without removing the head of the tool from the Allen fastener. There are many ratchet mechanisms 16 that may be used to achieve the desired objective. In one preferred embodiment, the ratcheting mechanism 16 includes a disk, shaft or wheel on which a pawl rests. The pawl is pivoted so that it can move or bounce over the teeth of the ratchet in a single selected direction. If the pawl or ratchet moves in the reverse direction, the pawl engages the teeth of the ratchet to prevent movement or slippage. The pawl may also move to and fro to assure the ratchet only engages and moves in a single direction.

This allows the ratchet mechanism 16 to apply a force in one direction while rotating freely in the other direction, which is extremely beneficial to users of the ratcheting Allen wrench 10 in a bi-directional setting. Alternative ratcheting systems exist that would be applicable for use with the present invention. As shown in FIG. 1, the present invention is capable of multiple configurations. In an additional embodiment, the ratchet mechanism 16 is covered by the handles when folded up so that when folded, the first handle 12 and second handle 14 abut each other, and then can be unfolded for use.

Figure 2:
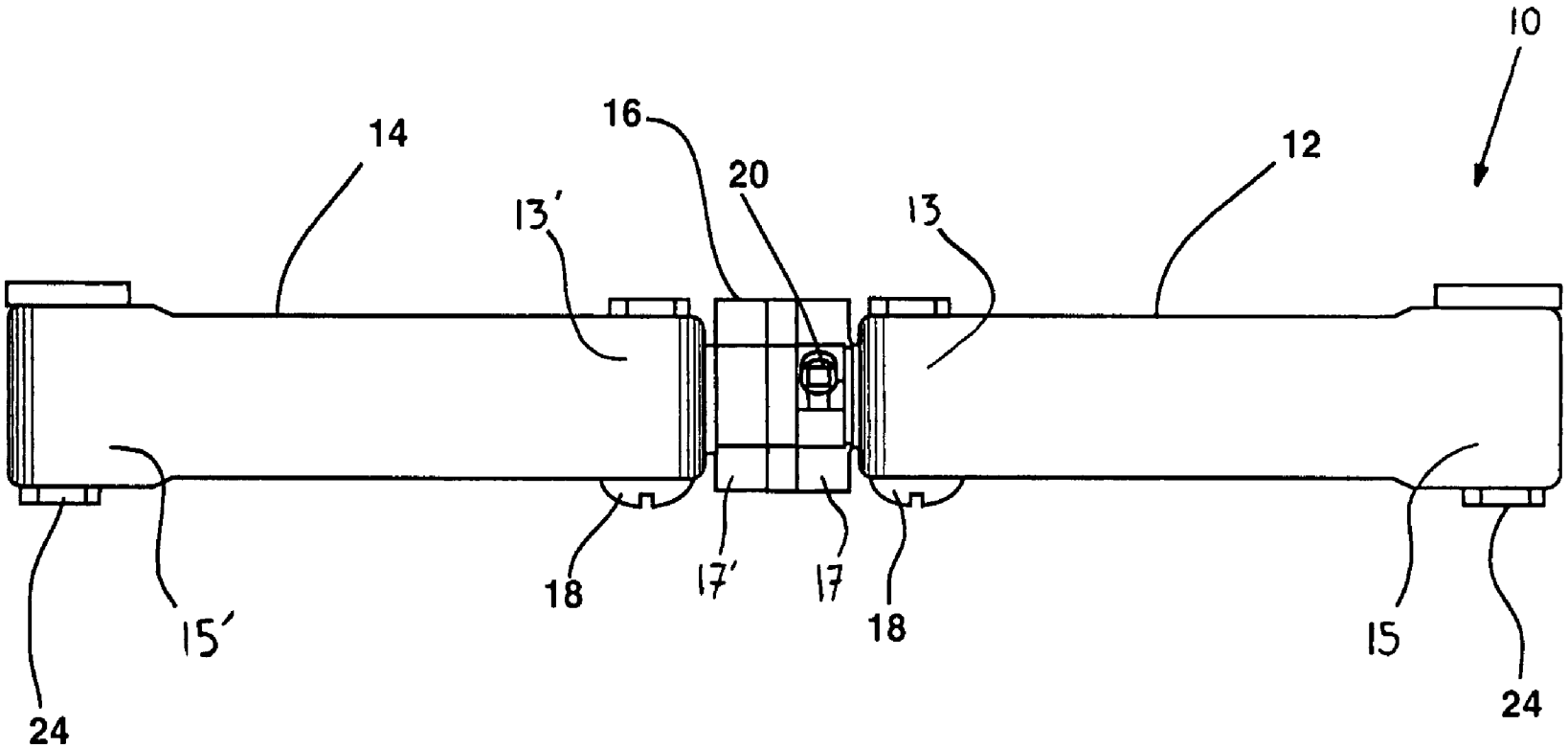
FIG. 2 is a top view of the embodiment shown in FIG. 1.

FIG. 2 is a top view of the embodiment of FIG. 1. The ratchet mechanism 16 preferably includes a direction selector 20 for determining which direction the ratchet mechanism 16 and corresponding pawl will be engaged, and in which direction it will rotate freely. The direction selector 20 may be a lever, button, switch or other mechanical device that allows a user to select the engaged ratcheting direction of the ratchet mechanism 16.

Figure 3:
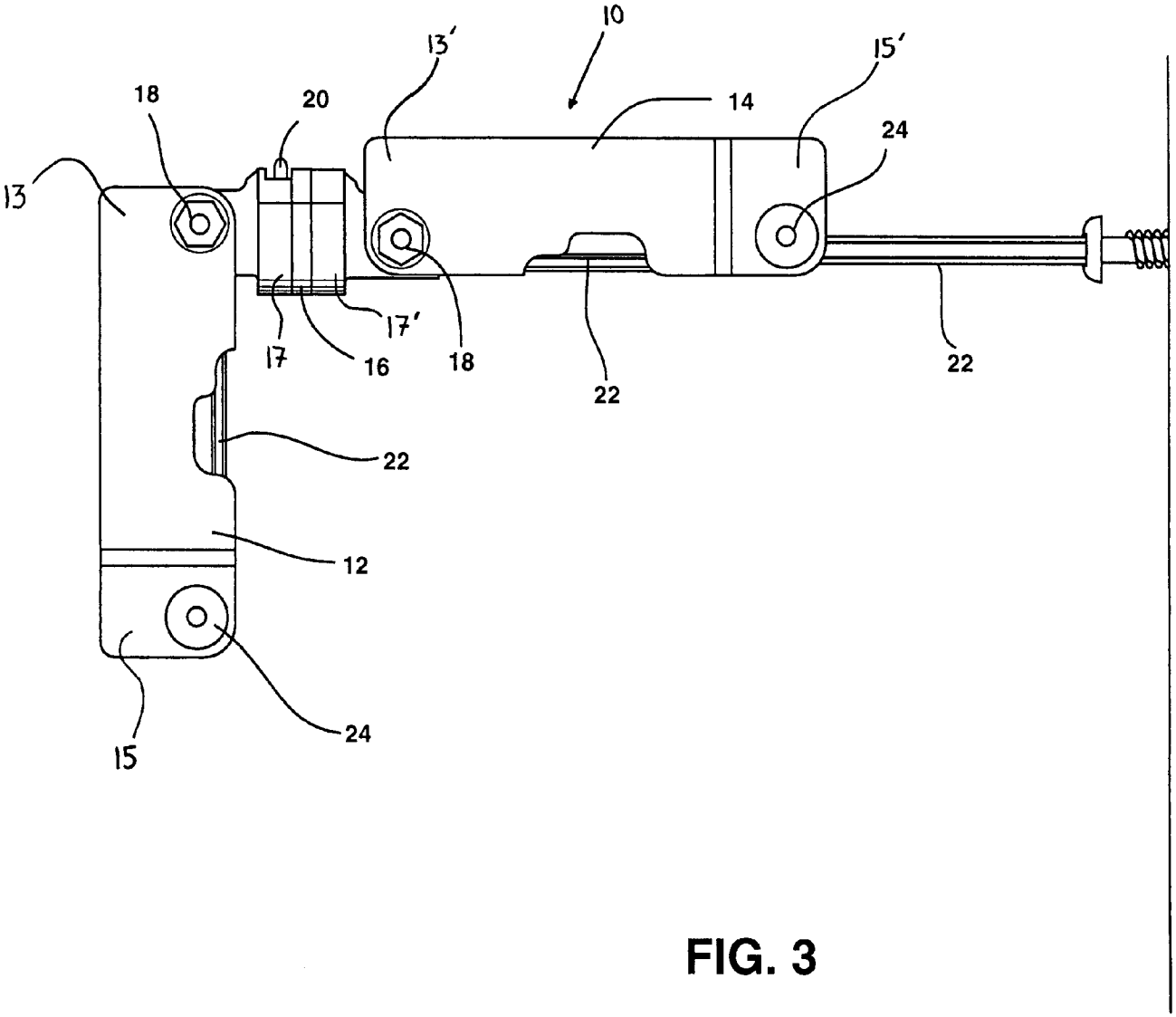
FIG. 3 is a side view of the embodiment in FIG. 1 shown partially extended and in use.

FIG. 3 is a side view of the embodiment in FIG. 1 shown partially extended and in use. Because the first handle 12 and second handle 14 are movably connected to the ratchet mechanism 16, either handle may be used to apply force or torque to allow the ratcheting Allen wrench 10 to be a very flexible tool. For example, a user working on a bicycle may desire to tighten an Allen bolt, and as a result would use the direction selector 20 to enable the ratcheting Allen wrench 10 and corresponding socket to tighten the Allen screw in a correct direction. The ratcheting mechanism 16 allows a user to engage the ratcheting Allen wrench 10 for applying force to an Allen screw in a single direction while still allowing the tool to rotate freely about the socket in the opposite direction.

The inner end 13' of the second handle 12 is hingedly attached to the second end 17' of the ratchet mechanism 16 by another handle fastener 18. Preferably, the first handle 12 and second handle 14 are hingedly fastened to the first end 17 and second end 17' of the ratchet mechanism 16 in a similar fashion. The present invention allows the ratcheting Allen wrench 10 to be gripped and/or used by gripping the first handle 12 or second handle 14. The first handle 12 and second handle 14 are preferably ergonomically shaped to prevent injuries to a user's hand during prolonged or strenuous use of the ratcheting Allen wrench 10. In the preferred embodiment, the edges of the first handle 12 and second handle 14 are rounded to prevent such injuries.

Figure 4:
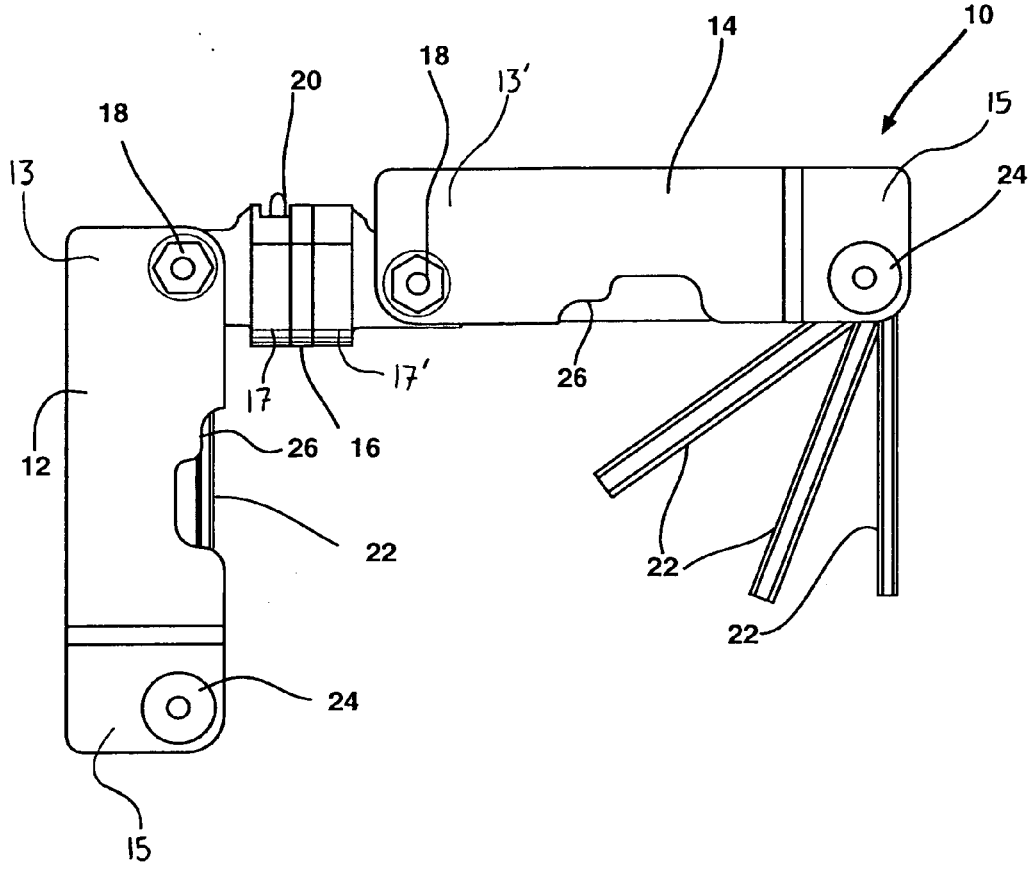
FIG. 4 is a side view of the embodiment shown in FIG. 1 in a partially extended position.

FIG. 4 is a side view of the embodiment shown in FIG. 1 in a partially extended position. The ratcheting Allen wrench 10 also includes multiple Allen tools 22 hingedly attached to the outer end 15 of the first handle 12 and the second handle 14 by tool fasteners 24. The Allen tools 22 are multiple sizes and lengths configured to adjust various Allen head fastenings.

Figure 5:
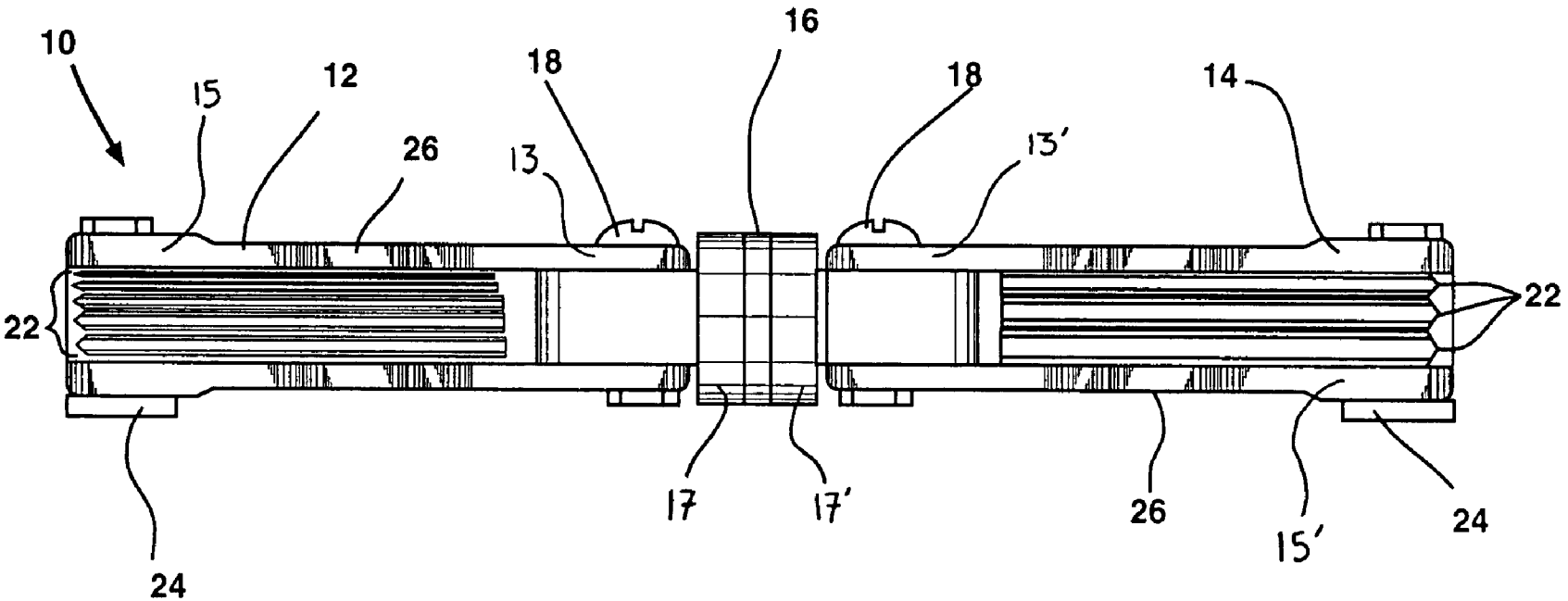
FIG. 5 is a bottom view of the embodiment shown in FIG. 1.

FIG. 5 is a bottom view of the embodiment shown in FIG. 1. The Allen tools 22 are connected to the tool fasteners 24 so that they may be retracted by a user for use on an Allen screw or other Allen type element. In one embodiment, the Allen tools 22 have an end that forms a substantially circular shape to allow the tool fastener 24 to pass through the Allen tools 22 and be fastened to the outer edges of the handles. In another preferred embodiment, the ratcheting Allen tool 10 may include different types of tools including blades, screwdrivers (both Phillips and standard), prying devices, and other miscellaneous tools or adapters that may be similarly attached to the tool fastener 24 and adapted for use. In one embodiment, a tool adapter tool hingedly fastened to the ratcheting Allen tool 10 may allow sockets, screwdriver heads or Allen heads to be attached or removed, thereby allowing the ratcheting Allen wrench 10 to be used for various tools.

The handles are preferably partially hollowed or define tool receptacle cavities that allow the multiple Allen tools 22 to be rotated within the first handle 12 and second handle 14 when not in use. This allows the Allen tools 22 to be properly stored, and additionally protects the user from injury or catching the Allen tools 22 on something while working.

The first handle 12 and second handle 14 of the ratcheting Allen wrench 10 preferably define at least one cut-away section 26 for allowing a user to easily access any one of the multiple Allen tools 22 stored within the two handles. Each cut-away 26 allows a user to more easily grab and rotate the Allen tools 22 for use. In one embodiment, the cut-away 26 allows a user to use a finger or fingernail to grip the Allen tool 22 for easy access and withdrawal.

In one preferred embodiment, the first handle 12 and second handle 14 may hinge outward from the tools until each handle is aligned with the socket 16. In this configuration the handle may be prevented from opening further because of the handle fastener 18 and how it is secured to the ratchet mechanism 16. In many applications this limitation is beneficial by allowing the user to use this locking motion to apply torque against a fastener.

In another preferred embodiment, the handles and corresponding handle fasteners 18 are positioned so that when folded either inward or outward or both, each handle actually touches, substantially encompassing the socket within the inner ends of the handles. In one preferred embodiment, the ratcheting Allen wrench 10 may be small enough to be folded up and inserted in a user's pocket. In larger scale applications, Allen tools 22 or other tools attached to the ratcheting Allen wrench 10 are larger thereby condensing into a much larger footprint even when folded. The ratcheting Allen wrench 10 may also include a further tool locking mechanism for locking a single Allen tool 22 or multiple Allen tools 22 into a fixed position during use as a safety device or for storage purposes.

In one example of usage, a female user decides that she would like to assemble some furniture with Allen head bolts. In addition, there are many Allen head bolts that need to be tightened, some at unusual angles and positions. The user begins by removing the ratcheting Allen wrench from her pocket or by bringing it from its storage location. If the ratcheting Allen wrench has been folded, the user unfolds the tool for use. The user must then correctly set the direction selector of the socket so that the socket and corresponding Allen tool engages the Allen bolt in the correct direction to tighten the fastener as needed. The user may then position the handles and Allen tool so that the Allen tool is correctly positioned in the Allen head of the bolt. The user may then use the ratcheting feature of the ratcheting Allen wrench to tighten the Allen head bolt without removing the Allen tool from the bolt at every turn, or when the position no longer allows rotation of the handles. This feature provides a great benefit over single function Allen tools or other compilations of Allen tools connected in a rigid manner that does not allow for handle positioning and ratcheting.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A folding multipurpose adjustable tool comprising:

a first handle;

a ratchet hingedly fastened to said first handle for providing a ratcheting mechanism engaging in one direction and rotating freely in another as selected by a user;

at least one tool hingedly fastened to said first handle;

a second handle hingedly fastened to an opposite end of said ratchet as said first handle; and at least one tool hingedly fastened to said second handle.

2. The folding multipurpose adjustable tool of claim 1, further comprising a locking mechanism for locking or unlocking at least one tool into a fixed position to facilitate use.

3. The folding multipurpose adjustable tool of claim 1, wherein at least one tool may be stored within said first handle and said second handle.

4. The folding multipurpose adjustable tool of claim 1, wherein said ratchet further comprises a direction selector for determining which direction said ratchet mechanism will be engaged and in which direction it will rotate freely.

5. The folding multipurpose adjustable tool of claim 1, wherein said first handle and said second handle define at least one cut-away for easy access to at least one tool positioned within.

6. The folding multipurpose adjustable tool of claim 1, wherein said first handle and said second handle are ergonomically shaped to prevent injury to a user's hand during use.

7. The folding multipurpose adjustable tool of claim 1, wherein said folding multipurpose adjustable tool is pocket sized.

8. The folding multipurpose adjustable tool of claim 1, wherein at least one tool is removable for replacing, adding and substituting additional tools.

9. The folding multipurpose adjustable tool of claim 8, wherein at least one tool is any of an Allen tool, a screwdriver, tool adapter, blade, scissors, pliers and pry tools.

10. The folding multipurpose adjustable tool of claim 1, wherein said first handle and said second handle may be folded substantially enclosing said ratchet.

11. The folding multipurpose adjustable tool of claim 1, wherein said first handle and said second handle only open to a position parallel with said ratchet.

12. The folding multipurpose adjustable tool of claim 1, wherein said first handle and said second handle may be closed so that they abut one another lengthwise.

13. The ratcheting Allen wrench of claim 3, wherein said ratchet mechanism further comprises a direction selector for determining which direction said ratchet mechanism will be engaged and in which direction it will rotate freely.

14. The ratcheting Allen wrench of claim 3, wherein at least one Allen tool is pivotally rotated and protected within said first and said second handle when not in use.

15. The ratcheting Allen wrench of claim 3, wherein said first and second handle further define at least one cut-away for easily accessing at least one Allen tool from a side of said first handle and said second handle.

16. The ratcheting Allen wrench of claim 3, wherein said first and second handles further define a hollow tool receptacle cavity for receiving and storing at least one Allen tool within said first handle and said second handle.

17. A ratcheting Allen wrench comprising:

a first handle comprising an inner and outer end for gripping and using said ratcheting Allen wrench;

a ratcheting mechanism comprising a first and second end wherein said first end is hingedly connected to said inner end of said first handle by a handle fastener, wherein said ratcheting mechanism further comprises a direction selector for selecting the engaged ratcheting direction;

a second handle comprising an inner and outer end for gripping and using said ratcheting Allen wrench wherein said inner end of said second handle is hingedly connected to said second end of said ratchet mechanism; and at least one Allen tool hingedly attached to said outer end of said first handle and said outer end of said second handle by a tool fastener wherein at least one Allen tool is stored within said first and second handle when not in use.

18. A ratcheting Allen wrench comprising:

a first handle comprising an inner and outer end for gripping and using said ratcheting Allen wrench;

a ratcheting mechanism comprising a first and second end wherein said first end is hingedly connected to said inner end of said first handle by a handle fastener, wherein said ratcheting mechanism further comprises a direction selector for selecting the engaged ratcheting direction;

a second handle comprising an inner and outer end for gripping and using said ratcheting Allen wrench wherein said inner end of said second handle is hingedly connected to said second end of said ratchet mechanism;

a plurality of Allen tools hingedly attached to said outer end of said first handle and said outer end of said second handle by a tool fastener wherein said plurality of Allen tools are stored within said first and second handle when not in use;

a tool locking mechanism for locking said plurality of Allen tools into a fixed position during use or storage; and at least one cut-away defined by said first handle and said second handle for easily accessing said plurality of Allen tools.

* * * * *